US009797623B1

(12) United States Patent
Tom

(10) Patent No.: US 9,797,623 B1
(45) **Date of Patent: *Oct. 24, 2017**

(54) BATH FAN AND HEATER WITH COVER HAVING ADJUSTABLE LUVER OR DEPRESSIBLE FASTENER AND DEPRESSIBLE RELEASE

(71) Applicant: Chien Luen Industries Co., Ltd., Inc., Oakland Park, FL (US)

(72) Inventor: Lawrence Tom, Smryna, GA (US)

(73) Assignee: Chien Luen Industries Co., Ltd. Inc., Oakland Park, FL (US)

( * ) Notice: Subject to any disclaimer, the term of this patent is extended or adjusted under 35 U.S.C. 154(b) by 206 days.

This patent is subject to a terminal disclaimer.

(21) Appl. No.: 14/822,650

(22) Filed: Aug. 10, 2015

Related U.S. Application Data

(62) Division of application No. 13/269,171, filed on Oct. 7, 2011, now Pat. No. 9,103,104.

(60) Provisional application No. 61/391,134, filed on Oct. 8, 2010.

(51) Int. Cl.
*F24F 7/06* (2006.01)
*F24H 3/04* (2006.01)

(52) U.S. Cl.
CPC ..... *F24H 3/0411* (2013.01)

(58) Field of Classification Search
CPC .. F24F 2007/002; F24F 7/06; F24F 2007/001; E03D 9/052; E03D 9/04
USPC ..... 454/237, 241, 248, 249, 254, 349, 354
See application file for complete search history.

(56) References Cited

U.S. PATENT DOCUMENTS

| | | | |
|---|---|---|---|
| 1,823,479 | A | 9/1931 | Venderbush |
| 2,519,503 | A | 8/1950 | Rigaumont |
| 2,689,906 | A | 9/1954 | Corbett |
| 2,697,163 | A | 12/1954 | Spear |
| 2,950,859 | A | 8/1960 | Kirk |
| 3,065,686 | A | 11/1962 | Geocaris |
| 3,068,341 | A | 12/1962 | Ortiz |
| 3,125,943 | A | 3/1964 | Geocaris |
| 3,223,019 | A | 12/1965 | Schuh |
| 3,227,063 | A | 1/1966 | Lambert |

(Continued)

OTHER PUBLICATIONS

Tom, Lawrence, Office Action Summary dated Nov. 7, 2014 for U.S. Appl. No. 13/289,312, filed Nov. 4, 2011, 14 pages.

(Continued)

*Primary Examiner* — Steven B McAllister
*Assistant Examiner* — Ko-Wei Lin
(74) *Attorney, Agent, or Firm* — Brian S. Steinberger; Law Offices of Brian S. Steinberger, P.A.

(57) ABSTRACT

Apparatus, systems and methods of using 70 CFM ventilation fans with heaters for bathrooms having depressibly engageable and depressibly releaseable light covers. The novel ventilation fans and heaters can be mounted to structure in ceilings and inside walls with telescoping suspension brackets that are affixed directly to separate sides of the housing to support the housing against joists and structural supports behind the ceiling. Adjustable louvers on the grill cover allow for outgoing heated air to travel in a different direction into a space from the incoming air travelling into the housing. Plastic type housings around blower wheels reduce undesirable noise effects. Light covers can be easily opened and closed by using depressible engageable fasteners, and depressible release fasteners.

19 Claims, 19 Drawing Sheets

(56) References Cited

U.S. PATENT DOCUMENTS

| | | | | |
|---|---|---|---|---|
| 3,246,137 | A | 4/1966 | Zagel | |
| 3,665,838 | A | 5/1972 | Shepherd | |
| 3,785,271 | A | 1/1974 | Joy | |
| 4,510,851 | A | 4/1985 | Sarnosky | |
| 4,526,318 | A | 7/1985 | Fleming | |
| 4,537,117 | A | 8/1985 | Cavestany | |
| 4,589,476 | A | 5/1986 | Berner | |
| 4,616,696 | A | 10/1986 | Brundrett et al. | |
| 4,657,291 | A | 4/1987 | Kurosaki | |
| 4,681,024 | A | 7/1987 | Ivey | |
| 4,726,559 | A | 2/1988 | Hultmark | |
| 4,798,518 | A | 1/1989 | Holzberger et al. | |
| 4,867,640 | A | 9/1989 | Penlesky | |
| 4,954,049 | A | 9/1990 | Armbuster | |
| 5,232,152 | A | 8/1993 | Tsang | |
| 5,567,200 | A | 10/1996 | Swartzendruber | |
| 5,620,370 | A | 4/1997 | Umai | |
| 5,934,783 | A | 8/1999 | Yoshikawa | |
| 6,161,175 | A | 12/2000 | Kim | |
| 6,215,885 | B1 | 4/2001 | Geiger | |
| 6,261,175 | B1 | 7/2001 | Larson | |
| 6,329,908 | B1 | 12/2001 | Frecska | |
| 6,340,237 | B1 | 1/2002 | Koga | |
| D457,232 | S | 5/2002 | Miura | |
| D457,616 | S | 5/2002 | Yamanaka | |
| 6,384,352 | B1 | 5/2002 | Ellman et al. | |
| 6,488,579 | B2 | 12/2002 | Larson | |
| 6,538,881 | B1 | 3/2003 | Jeakins | |
| 6,632,006 | B1 | 10/2003 | Rippel | |
| 6,802,770 | B2 | 10/2004 | Larson | |
| 6,897,580 | B2 | 5/2005 | White | |
| 6,979,169 | B2 | 12/2005 | Penlesky | |
| D521,145 | S | 5/2006 | Craw | |
| 7,128,303 | B2 | 10/2006 | Penlesky | |
| D535,433 | S | 1/2007 | Craw | |
| 7,175,309 | B2 | 2/2007 | Craw | |
| 7,203,416 | B2 * | 4/2007 | Craw | F24H 3/0411 392/350 |
| D565,716 | S | 4/2008 | Jacak | |
| D575,387 | S | 8/2008 | Zakula | |
| D577,805 | S | 9/2008 | Adrian | |
| D581,508 | S | 11/2008 | Miyake | |
| 7,455,432 | B2 | 11/2008 | Craw | |
| 7,455,500 | B2 | 11/2008 | Penlesky | |
| 7,481,559 | B1 | 1/2009 | Rashidi | |
| 7,591,867 | B2 | 9/2009 | Choi | |
| 7,606,379 | B2 | 10/2009 | Ivey et al. | |
| 7,654,495 | B2 | 2/2010 | Adrian | |
| 7,677,964 | B1 | 3/2010 | Bucher | |
| 7,845,803 | B2 | 12/2010 | Lv | |
| 7,881,827 | B2 | 2/2011 | Park et al. | |
| 7,922,335 | B2 | 4/2011 | Sakai | |
| 7,993,037 | B1 | 8/2011 | Buse | |
| D653,323 | S | 1/2012 | Jacak | |
| 8,104,502 | B2 | 1/2012 | Nakata | |
| D654,998 | S | 2/2012 | Zakula | |
| 8,113,148 | B2 | 2/2012 | Chem | |
| 8,172,655 | B2 | 5/2012 | Liu | |
| 8,218,805 | B2 | 7/2012 | Hornback | |
| 8,295,504 | B2 | 10/2012 | Ady et al. | |
| D681,249 | S | 4/2013 | Tom | |
| 8,485,696 | B2 | 7/2013 | Pringle et al. | |
| 8,591,037 | B2 | 11/2013 | Nagumo | |
| 8,961,126 | B1 | 2/2015 | Tom | |
| 9,022,846 | B1 | 5/2015 | Tom | |
| 9,097,265 | B1 | 8/2015 | Tom | |
| 9,103,104 | B1 | 8/2015 | Tom | |
| 9,188,132 | B1 | 11/2015 | Tom | |
| 2005/0006549 | A1 | 1/2005 | Liu | |
| 2005/0111972 | A1 | 5/2005 | Penlesky | |
| 2006/0172693 | A1 | 8/2006 | Lundquist | |
| 2006/0199515 | A1 | 9/2006 | Lasko | |
| 2007/0131827 | A1 | 6/2007 | Nevers | |
| 2008/0261508 | A1 | 10/2008 | Deng | |
| 2008/0318515 | A1 | 12/2008 | Yeung | |
| 2009/0028372 | A1 | 1/2009 | Cerasuolo | |
| 2009/0073702 | A1 | 3/2009 | Craw | |
| 2009/0116189 | A1 | 5/2009 | Chang | |
| 2009/0170421 | A1 * | 7/2009 | Adrian | F24F 7/06 454/349 |
| 2010/0009621 | A1 | 1/2010 | Hsieh | |
| 2010/0112927 | A1 | 5/2010 | Marga | |
| 2010/0171681 | A1 | 7/2010 | Cabanas et al. | |
| 2010/0226139 | A1 | 9/2010 | Lynch | |
| 2012/0250335 | A1 | 10/2012 | Nakano | |
| 2012/0274767 | A1 | 11/2012 | Hornback | |
| 2013/0084793 | A1 | 4/2013 | Yang et al. | |
| 2013/0114826 | A1 | 5/2013 | Chang | |
| 2014/0177900 | A1 | 6/2014 | Berkman | |

OTHER PUBLICATIONS

Tom, Lawrence, Listing of pending claims for U.S. Appl. No. 13/289,312, filed Nov. 4, 2011, 7 pages.

Tom, Lawrence, Office Action Summary dated Oct. 22, 2014 for U.S. Appl. No. 13/042,992, filed Mar. 8, 2011, 16 pages.

Tom, Lawrence, Listing of pending claims for U.S. Appl. No. 13/042,992, filed Mar. 8, 2011, 7 pages.

Tom, Lawrence, Office Action dated Jan. 8, 2015 for U.S. Appl. No. 13/233,700, filed Sep. 15, 2011, 25 pages.

Tom, Lawrence, Amendment Response dated Oct. 3, 2014 for U.S. Appl. No. 13/233,700, filed Sep. 15, 2011, 13 pages.

* cited by examiner

BATH FAN AND HEATER WITH COVER HAVING ADJUSTABLE LUVER OR DEPRESSIBLE FASTENER AND DEPRESSIBLE RELEASE

This application is a Divisional application of U.S. patent application Ser. No. 13/269,171 filed Oct. 7, 2011, now U.S. Pat. No. 9,103,104, which claims the benefit of priority to U.S. Provisional Patent Application Ser. No. 61/391,134 filed Oct. 8, 2010. The entire disclosure of each of the applications listed in this paragraph are incorporated herein by specific reference thereto.

FIELD OF INVENTION

This invention relates to ventilation exhaust fans, and in particular to apparatus, systems and methods of 70 CFM ventilation fans with heaters for bathrooms having light covers with adjustable louvers or depressible fasteners and depressible releases.

BACKGROUND AND PRIOR ART

Various types of bathroom ventilation fans have been proposed and used over the years. See for example, U.S. Pat. No. 4,867,640 to Penlesky et al.; U.S. Pat. No. 4,510,851 to Sarnosky et al.; U.S. Pat. No. 6,261,175 to Larson et al.; U.S. Pat. No. 6,488,579 to Larson et al.; U.S. Pat. No. 6,802,770 to Larson et al.; U.S. Pat. No. 7,203,416 to Craw et al.; and U.S. Pat. No. 7,654,495 to Adrian et al.

There have been many problems with the prior art. For example, many bath fans are difficult to be installed into a ceiling since the housings cannot be easily attached to different locations of joists in the ceiling. If a joist is off center to the middle of bathroom ceiling the bath fan is not easy to center in the room. Additionally, many of the bath fans have numerous parts which add extra manufacturing costs. And as a result a bath fan that requires assembly of the bath fan at a job site will incur undesirable extra labor and material costs to install. Additionally, many bath fans have to be wired to components inside of the housings which also require extra expensive labor costs to make the connections onside during the installation of the bath fan.

Additional problems have included undesirable noise effects coming from the exhaust fans when the fans are being turned on. Still furthermore, the light covers on bath fans are often difficult to open up once the bath fan is installed. For example, many light covers require the user to unscrew fasteners, such as screws, and the like, which are quite difficult to work on when the light lens cover is on a ceiling mounted bath fan. Thus, having to replace burned out light bulbs can be difficult with the light covers on existing bath fans.

Thus, the need exists for solutions to the above problems with the prior art.

SUMMARY OF THE INVENTION

A primary objective of the present invention is to provide ventilation fans, apparatus, systems and methods for bathrooms with heaters that provides 70 (seventy) CFM (cubic feet of air per minute) in ventilation.

A secondary objective of the present invention is to provide ventilation fans, apparatus, systems and methods for bathrooms with heaters having depressibly engageable and depressibly releaseable light covers.

A third objective of the present invention is to provide ventilation fans, apparatus, systems and methods for bathrooms with heaters, having reduced noise effects from air being exhausted from the fan housings.

A fourth objective of the present invention is to provide ventilation fans, apparatus, systems and methods for bathrooms with heaters, having covers with adjustable louvers for adjusting airflow direction and closure of the airflow.

A fourth objective of the present invention is to provide ventilation fans, apparatus, systems and methods for bathrooms with heaters, that remove odors from rooms in which they are mounted.

The ventilation motor and the heater motor and the light can each be wired separately and used with separate wall switches in a room. For instance, the exhaust part can be turned on/off and pull air from the room. The heater can be on by itself and pull air into the heating element and heats up the air then pushes it back into the room. The light can be controlled separately too if you do not need the above components to be operating. The lens cover for the light is easily accessible by pushing and releasing the cover to change the light bulb. It attaches and secures itself the same way.

A ventilation fan for bathrooms can include a housing having closed top, side walls and open bottom, a blower wheel and motor inside of the housing, a receptacle box for the motor being located outside of the housing against an outer wall of the housing, a grill cover covering the open bottom of the housing, a light in the grill cover, wherein air enters into the housing and is exhausted therefrom by the motor run blower, and a depressible lens cover covering the light, the lens cover having at least one depressibly engageable and depressibly releaseable fastener receptacle and prong, which allow the lens cover to be pressed to lock the cover in place and to be pressed again to unlock and release the cover from covering the light. The motor can be an approximately 70 (seventy) CFM (cubic feet per minute) generating motor.

The fan housing can include a first elongated side telescoping bracket directly mounted along one side wall of the housing, and a second elongated side telescoping bracket directly mounted along an opposite side wall of the housing.

The depressibly engageable and releaseable fasteners can include female sockets with springs, and male prongs for being inserted into the female sockets, wherein the lens cover is attached to and released from the grill cover by the male prongs and female sockets. The depressibly engageable and releaseable fasteners can further include moveable inner parts inside of the sockets, wherein the springs are positioned beneath the inner parts, and bendable arms are attached to the inner parts, wherein initially depressing the male prongs into sockets causes the bendable arms to hook about enlarged heads on the male prongs to lock the lens cover in place, and subsequently depressing the male prongs causes the springs to push to out the inner parts to release the lens cover.

The fan can include a heating element inside the housing, wherein incoming air is heated and recirculated back through the grill;

The fan can include a plastic enclosure for completely surrounding the blower wheel to guide the air in a controlled path to prevent excess noise and provide maximum performance to exhaust or heat the air, so that air is trapped once it enters the blower wheel and guided to the outlet without any corners for the air to be stuck.

The grill can include incoming louvered grill portion for pulling the air from the space and to both the blower wheel and the heating element, and an outgoing heated air louvered grill portion for circulating the heated air back into the space.

At least one of the incoming louvered grill portion and the outgoing heated air louvered portion, can include adjustable louvers so as to direct the incoming air and the outgoing heated air in separate directions.

A ventilation fan for bathrooms, can include a housing having closed top, side walls and open bottom, a blower wheel and motor inside of the housing, a heating element inside the housing, a receptacle box for the motor and heating element being located outside of the housing against an outer wall of the housing, a grill cover covering the open bottom of the housing, a light in the grill cover, wherein air enters into the housing and is exhausted therefrom by the motor run blower, and incoming air is heated and recirculated back through the grill, a releaseable translucent lid cover for covering the light, female sockets with springs therein, male prongs for being inserted into the female sockets, wherein the lid cover is attached to and released from the grill cover by the male prongs and female sockets, and first and second pairs of suspension brackets, each pair being fixed to sides of the housing for mounting the housing in a ceiling or wall.

The motor can be an approximately 70 (seventy) CFM (cubic feet per minute) generating motor. The fan can include plastic enclosures that completely surround the blower wheel, to help guide the air in a controlled path to prevent excess noise and provide maximum performance to exhaust or heat the air. The enclosures allow for air to be trapped once the air enters the blower wheel and is guided to the outlet without any corners for the air to be stuck.

The grill can include an incoming louvered grill portion for pulling the air from the space and to both the blower wheel and the heating element, and an outgoing heated air louvered grill portion for circulating the heated air back into the space.

At least one of the incoming louvered grill portion and the outgoing heated air louvered portion, can include adjustable louvers so as to direct the incoming air and the outgoing heated air in separate directions.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

70 CFM Ventilation Bath and Heater Fan

A list of the components will now be described.

1. Bath fan and heater with light cover having adjustable louvers and/or depressible engageable fasteners and depressible release 10. Light cover/grill lens (light cover/lid/door)(opaque allows light to pass through)

Figure 1:
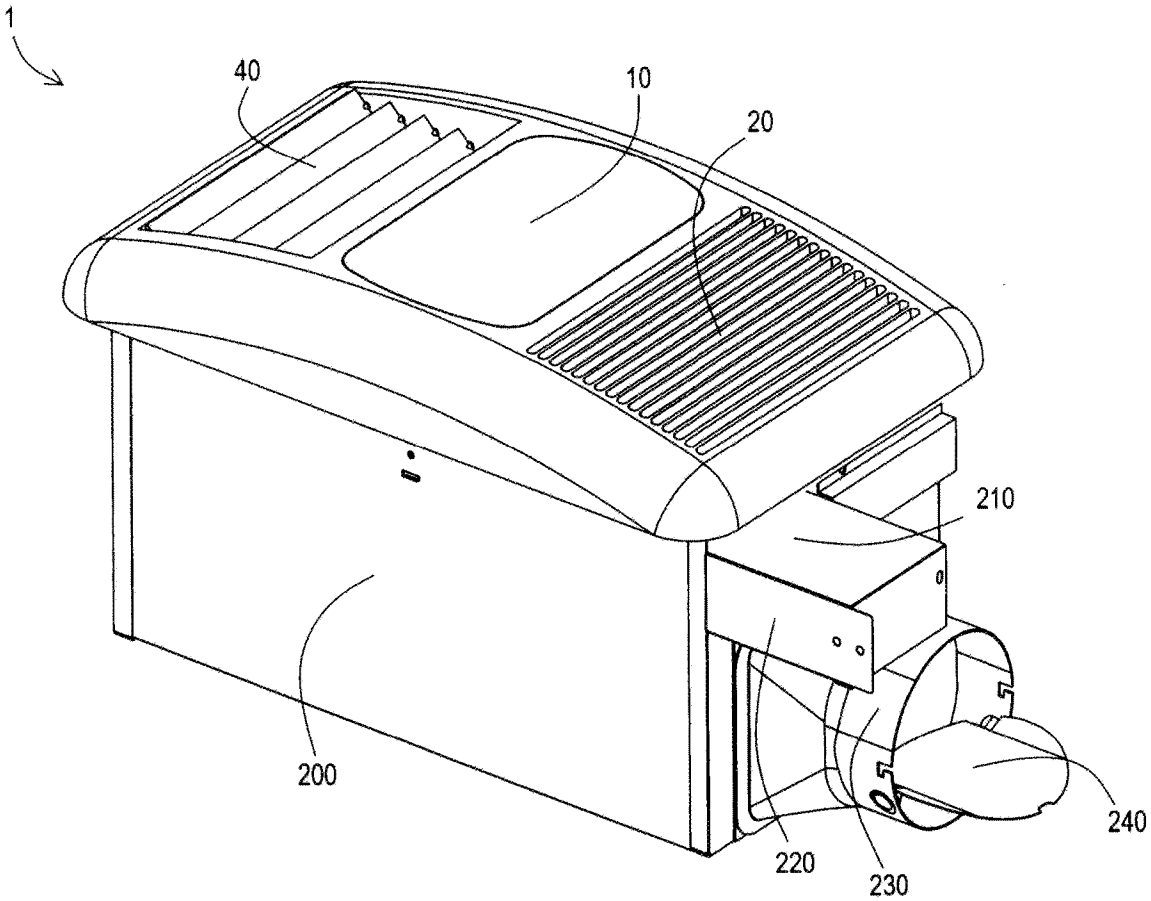
FIG. 1 is a lower side perspective view of the assembled ventilation and heater fan.
Figure 2:
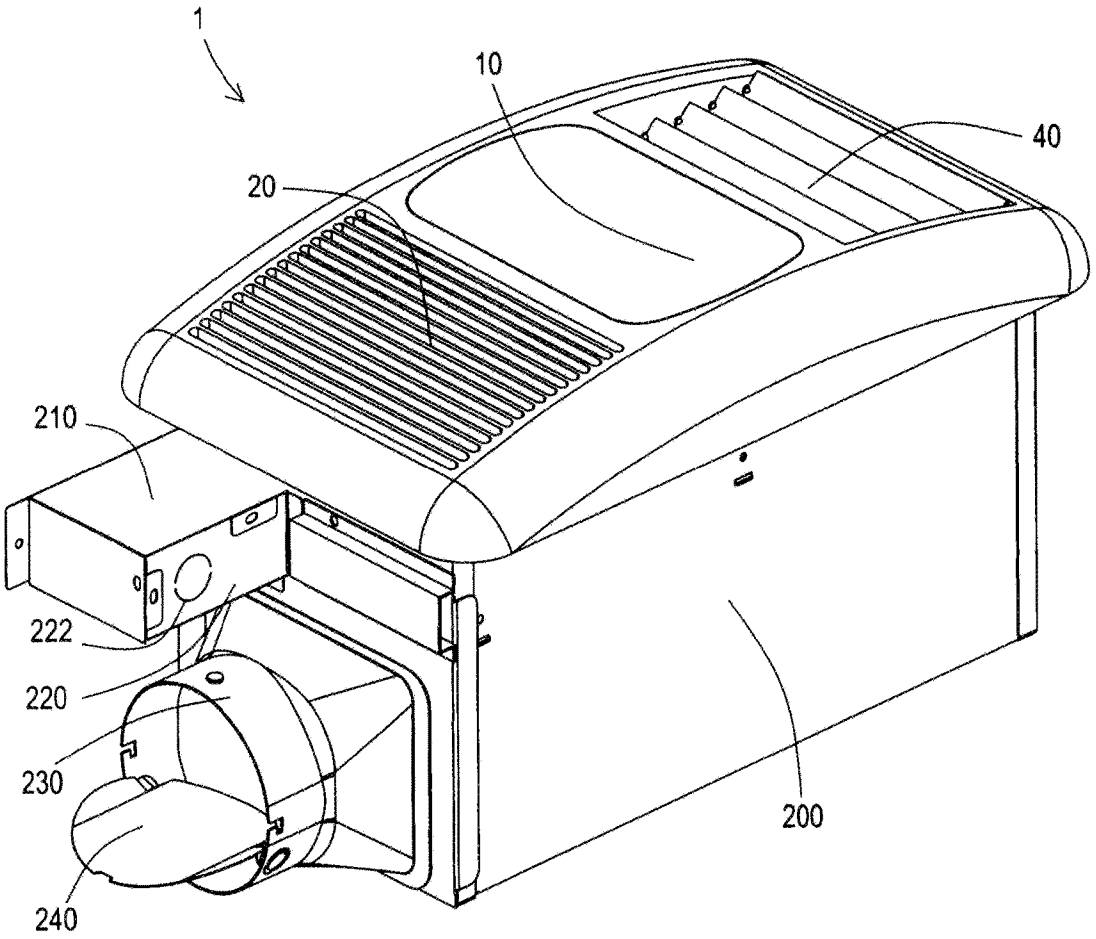
FIG. 2 is another lower side perspective of the ventilation and heater fan of FIG. 1.
Figure 3:
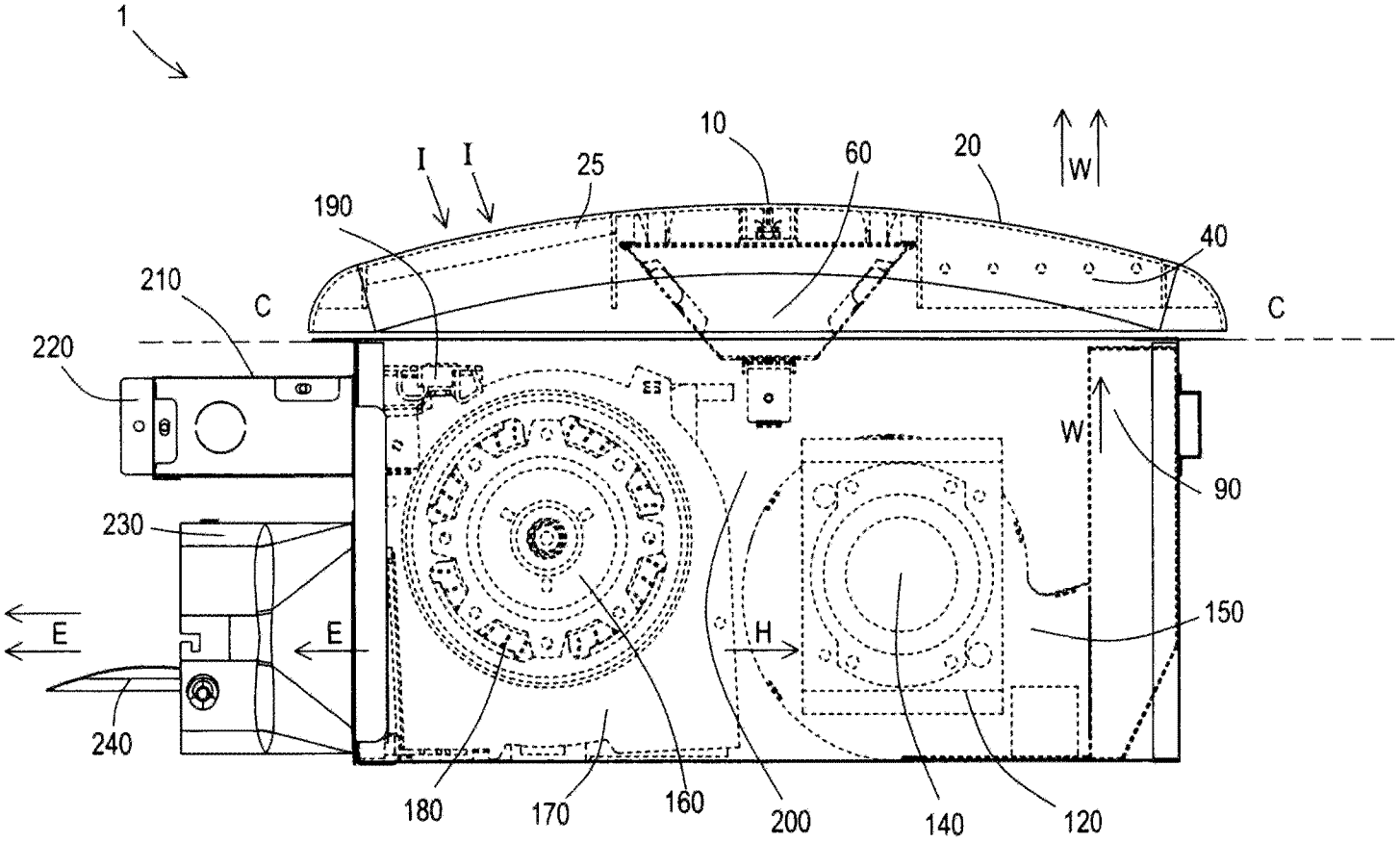
FIG. 3 is a side partial cross-sectional view of the ventilation and heater fan of FIG. 2.
Figure 4:
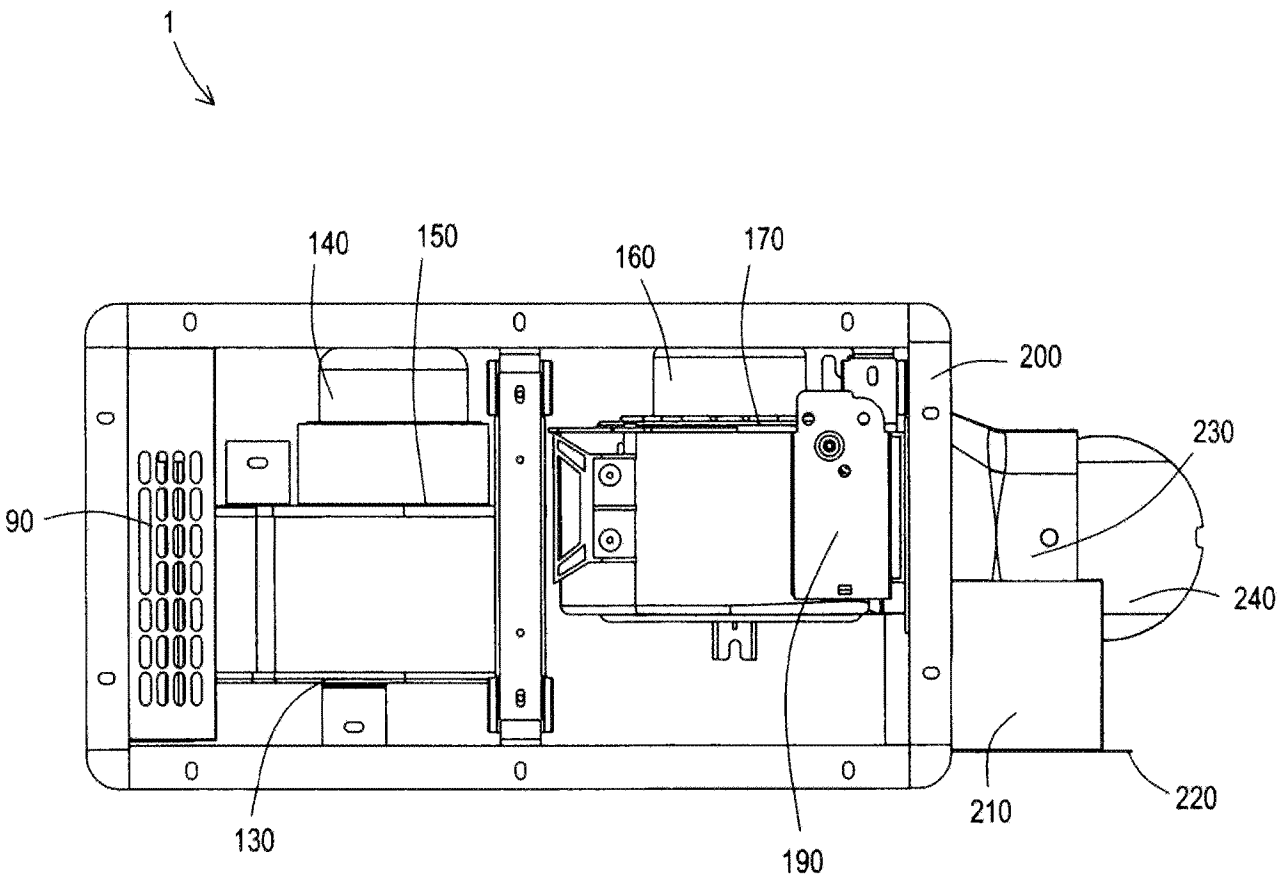
FIG. 4 is a top view of the ventilation and heater fan of FIG. 1.
Figure 5:
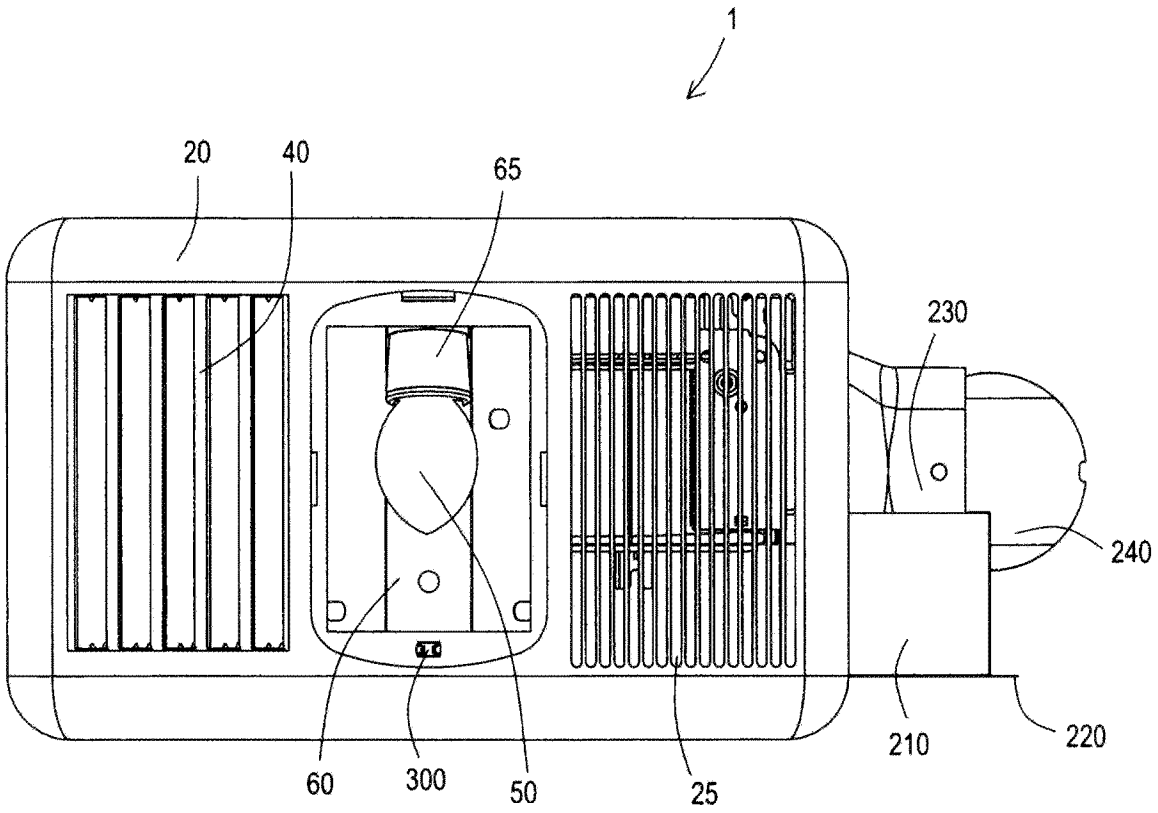
FIG. 5 is a lower view of the ventilation and heater fan of FIG. 1 with light cover removed.
Figure 6:
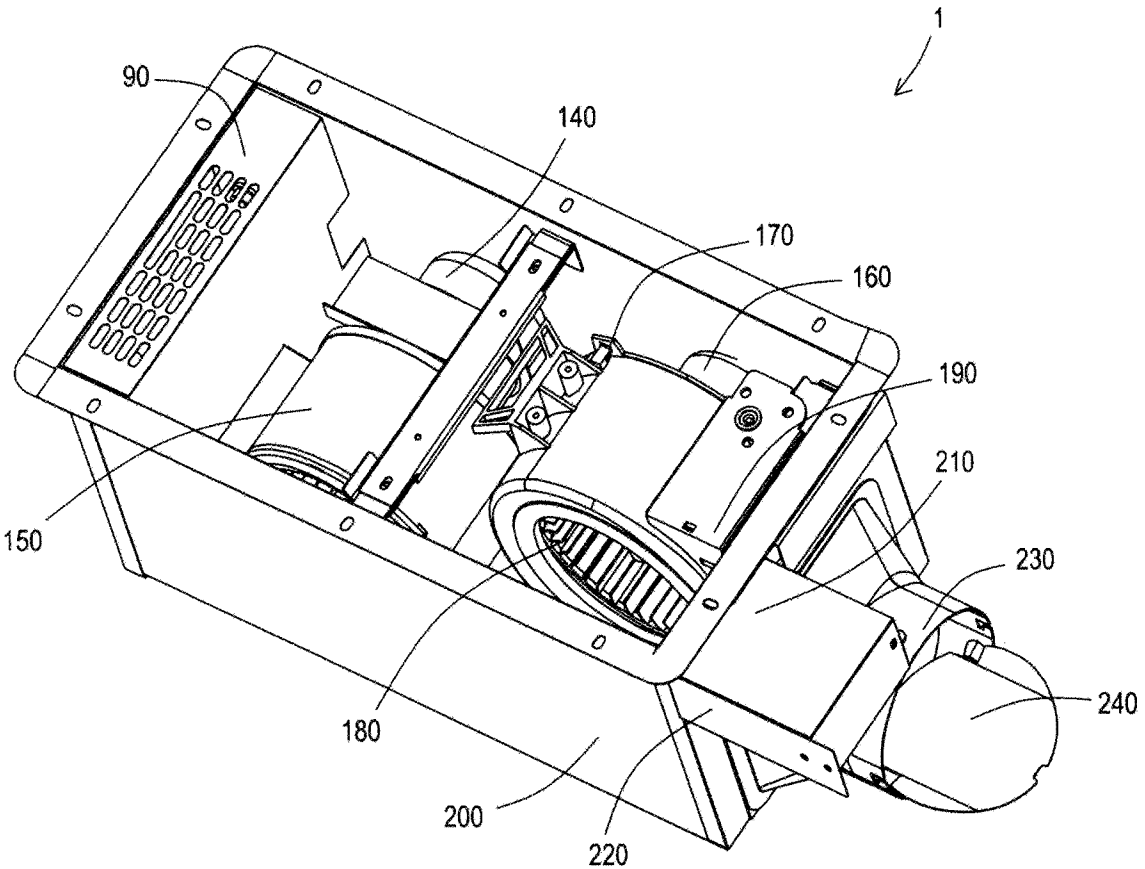
FIG. 6 is a lower perspective view of the ventilation and heater fan of FIG. 5 with grill cover removed.

20. Grill 25. fixed vents
300. Grill lens connecting block chip (depressible engageable and releasable fastener)
40. Shutter (5)(adjustable louvers)
50. Bulb (60 Watt candelabra bulb)
60. Light box (aluminum)
65. socket
70. Shutter adjust bracket
80. Heat element housing side plate (2) (galvanized steel)
90. Heat element housing front plate (galvanized steel)
92. top with vents
94. angled bottom
96. attachment tabs
100. Ceramic heating element
110. Heat element housing rear plate (galvanized steel)
120. Iron impeller (galvanized steel)
130. Iron impeller housing side plate
140. Motor for heating element
150. Iron impeller housing
152. motor side of housing
160. Bath fan motor
170. Motor seat
180. Blower/Impeller
190. Blower/Impeller housing
192. exhaust air output channel
194. side air inlet opening
196. footer(s)
200. Main Housing
210. Wiring box cover
220. Wiring box
230. Outlet
240. Damper
250. Suspension brackets
260. Suspension brackets
300. Grill lens connecting block chip (depressible engageable and releasable fastener)
310. inside part with bendable prong arms
312. bendable prong arms
313. side slot
314. side walls
316. bottom
317. indentation in bottom
318. riding tab stop
320. outside box
322. top end with enlarged edges
324. side walls
326. hook of outside box
327. spring fixture
328. longitudinal slot
330. pothook (L shape)
332. side extending protrusions on vertical leg
334. horizontal leg
340. internal spring
400. male prong with enlarged head
410. shaft
420. enlarged head
500. bath fan grill cover with opposite fixed vents
510. inside cavity for light source
550. hinge attachment for lens cover
600. lens cover
650. hinge attachment for grill cover
700. bath fan grill cover with four fixed vents
710. inside cavity for light fixture
750. hinge attachment for lens cover
800. lens cover FIG. 1 is a lower side perspective view of the assembled ventilation and heater fan 1 with light cover 10 having adjustable louvers 40 and depressible engageable fasteners and depressible release. FIG. 2 is another lower side perspective of the ventilation and heater fan 1 of FIG. 1. FIG. 3 is a side partial cross-sectional view of the ventilation and heater fan 1 of FIG. 2. FIG. 4 is a top view of the ventilation and heater fan 1 of FIG. 1. FIG. 5 is a lower view of the ventilation and heater fan 1 of FIG. 1 with light cover 10 removed. FIG. 6 is a lower perspective view of the ventilation and heater fan 1 of FIG. 5 with grill cover 20 and light cover 10 having been removed.

Figure 7:
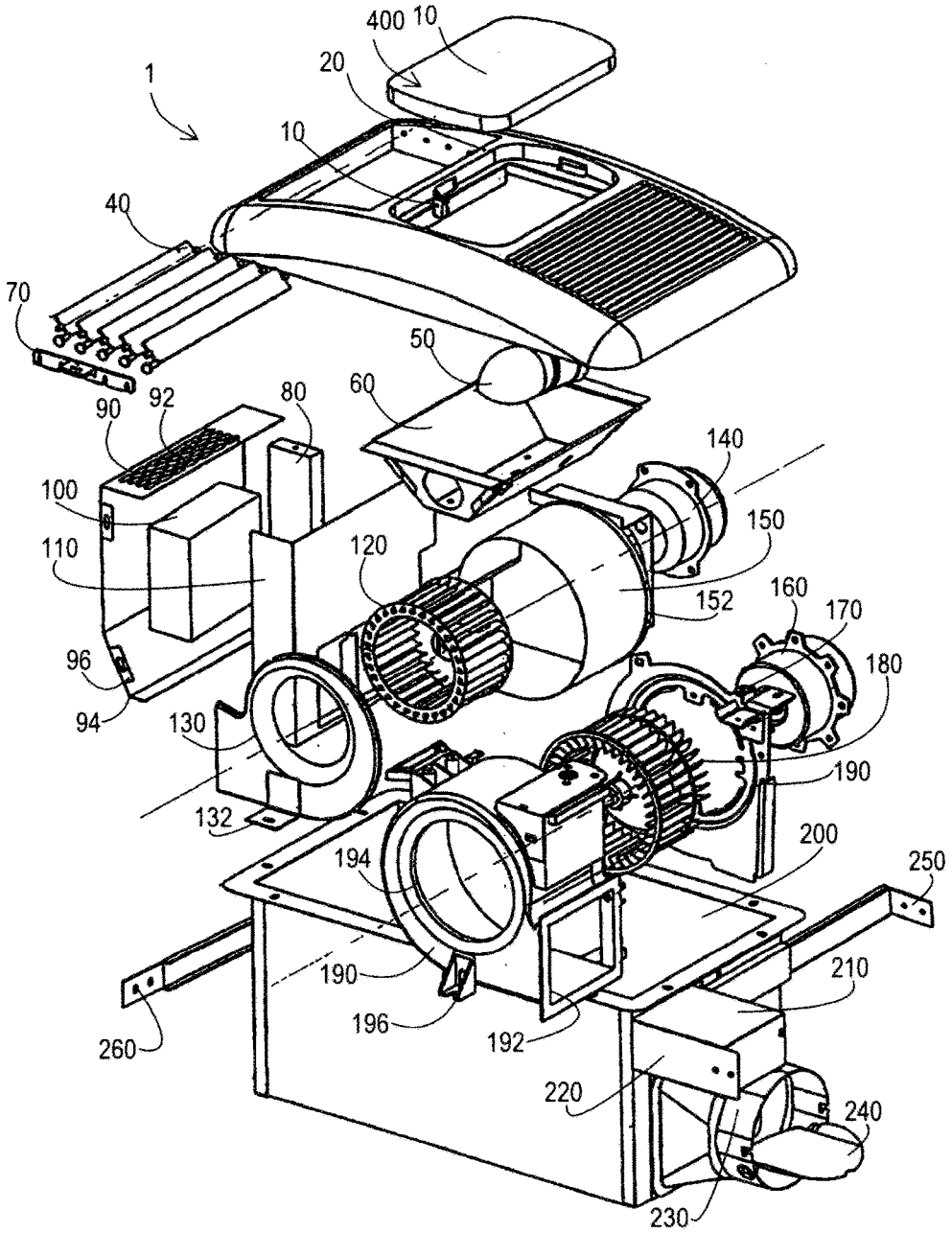
FIG. 7 is an exploded view of the housing, grill cover, light cover and separated blower and motor and separate heater components of the ventilation and heater fan of FIG. 1.
Figure 8:
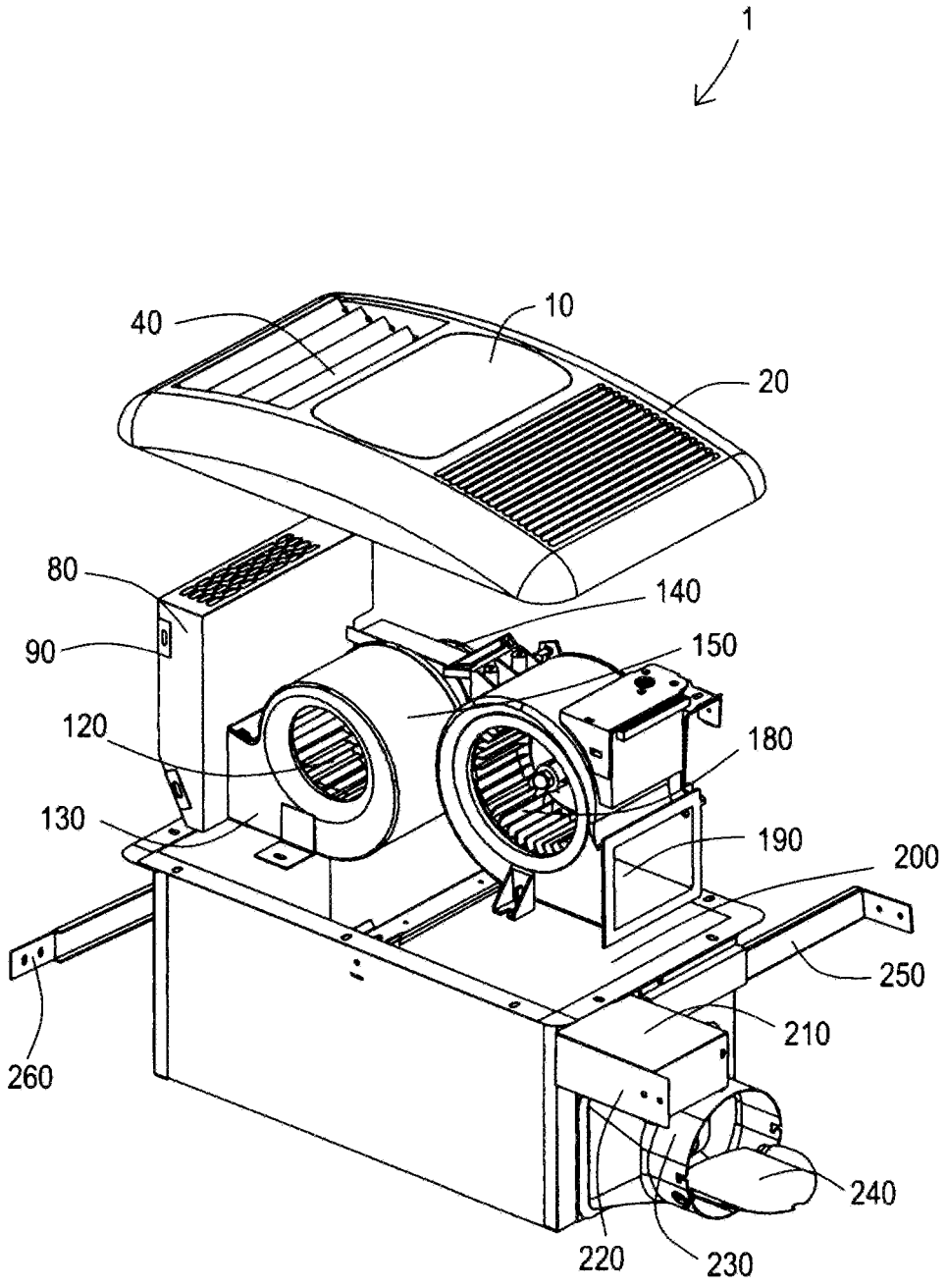
FIG. 8 is another exploded view of the housing and grill cover with the assembled blower and motor and heater components of FIG. 7.

FIG. 7 is an exploded view of the housing 200, grill cover 20, light cover 10 and separated blower 180 and motor 160 and separate heater components 100-150 of the ventilation and heater fan 1 of FIG. 1. FIG. 8 is another exploded view of the housing 200 and grill cover 20 with the assembled blower 180 and motor 160 and heater components 100-150 of FIG. 7.

Referring to FIGS. 1-8, the main housing 200 of the bath fan and heater invention 1, can be a generally box shape having closed sides, closed bottom, and open top (which is covered by the grill cover 200). The invention 1 can include both heater components 80-150 and air blower components 160-190.

The heater components 80-150 (FIGS. 3, 4, 6-8) can include two opposite facing heating element side plates 80 (one is shown for clarity), and a front plate 90 with upper bent top having vents 92 and angled bottom 94 and side attachment tabs 86 having through-holes for allowing the front plate 90 to be attached to side flanges of heat element rear plate 110, by fasteners, such as screws, bolts, rivets, and the like. Both the front plate 90 and the rear plate 110 can be formed from metal, such as but not limited to galvanized steel and the like. Inside the front plate 90 and rear plate 110 can be a heating element 100 such as a ceramic heating element.

A metal heater blower/impeller 120, such as an iron impeller, can have a blower wheel configuration with circumferential side blades. An electrical motor 140, such as a capacitor motor which can be completely enclosed to prevent moisture from entering into the motor, and effectively allowing the motor to last longer over time. Motor 140 can have a rotational axis that attaches to a mid portion of the blower wheel 120, to rotate the blower wheel 120. The blower 120 can be held in place by the motor 140 to be held within a blower housing 150, such as an iron housing, having a generally cylindrical shape with a side exhaust opening for moving air therefrom. An impeller side plate 130 having an opening therethrough which along with the motor 140 function as end plates for the open sides of blower housing 150. Side plate 130 can have a footer 132, with together with the bottom of housing 150 can be attached to the floor of housing 200 by fasteners, such as screws, bolts, rivets, and the like. Side flanges on the motor 140 can attach to edges around an opening in sidewall 152 (which can function as a motor seat) of the blower housing 150, by fasteners, such as screws, bolts, rivets, and the like.

The ceramic heating element 100 and bath fan can each have their separate motors 140, 160 and blower wheels 120, 180. They are even separated from each other inside the bath fan housing 200 so that air can be exhausted outside by the bath fan through outlet 230 with adjustable damper 240, while the heater side blows the warmer air into the room through angle adjustable shutters 40. The adjustable louvers 40 should be adjusted away from the bath fan side to prevent the warmer air being exhausted out.

Referring to FIGS. 3, 4, and 6-8, the air blower components 160-190, can include an electrical bath fan motor 160, such as a capacitor motor which can be completely enclosed to prevent moisture from entering into the motor, and effectively allowing the motor to last longer over time. Fan motor 160 can have side flanges that are attached by fasteners (such as those previously described) to edges along a through-hole in a motor seat plate 170. A rotatable axle on motor 160 can attach to a central portion of the blower wheel 180 to rotate the blower wheel 180. Motor seat 170 can have side flanges that can attach to edges along an open side of the blower housing 190 by fasteners (such as those previously described). Air can be pulled into the blower housing 190 by open side 194, and is blown out exhaust opening 192. Footers 196 on the bottom of blower housing 190 can attach the blower housing to the floor of the main housing 200 by fasteners (such as those previously described).

Components labeled 190 are plastic enclosures that completely surround the blower wheel 180. The enclosures helps guide the air in a controlled path to prevent excess noise and provide maximum performance to exhaust or heat the air. Air is trapped once it enters the blower wheel 180 and guided to the outlet 192 of the blower housing and outlet 230 of the housing 200 without any corners for the air to be stuck.

Power for the motors 140, 160 and light 50 can be wired to wire box 220 by a line, such as a white plastic bi-pin molex cable from each of the motors 140, 160 and light compartment 60 that plugs into the wiring box 220 with wiring box cover.

Referring to FIGS. 1-3 and 5-8, external household electrical power can be supplied to the bath fan and heater housing embodiment 1 through a side opening 222 in a side wall of the wiring box 220. The top opening and front opening of the wiring box 220 can be covered with an L-shaped wiring box cover 210 having tabs which connect the cover 210 to sidewalls of the wiring box by fasteners (such as those previously described). Conventional wires can be inside the junction box 210 and can be wired to a house power supply. Standard positive/negative wires for each light, heater, each motor is inside and can be wired to the house. Male plugs, such as Bi-pin molex can plug into the receptacles which is behind the junction box 220. The wires inside the junction box 220 can be connected to these receptacles and can be wired to the house. The invention can use electrical connections used in other bath fan inventions, by the assignee including, but not limited to those shown and described in copending U.S. patent application Ser. No. 13/219,236 filed Aug. 26, 2011, and copending U.S. patent application Ser. No. 13/168,112 filed Jun. 24, 2011, both of which are incorporated by reference.

Referring to FIGS. 7-8, the housing 200 is mounted by extension brackets 250, 260 that are fixably attached directly to the outer side of the housing. Each extension bracket is two pieces, with one fixed to an outside wall of the housing, and the second part has an L shaped end, where the second part telescopes in and out relative to the fixed part of the bracket. The L shaped end can attach to joists and other structural supports in a ceiling in which the housing 200 is mounted. Alternatively, other types of mount brackets can be used, such as bent flap ears. The invention can use telescoping brackets and ear type bent flange brackets similar to those in other inventions by the assignee including, but not limited to those shown and described in copending U.S. patent application Ser. No. 13/219,236 filed Aug. 26, 2011, and copending U.S. patent application Ser. No. 13/168,112 filed Jun. 24, 2011, both of which are incorporated by reference.

FIGS. 9A, 9B, 9C, 9D, 9E and 9F are enlarged cross-sectional views of the novel depressibly engageable and depressibly releasable fasteners used for the light cover 10 of the ventilation and heater fan 1 of the preceding figures.

Referring to FIGS. 1, 2, 5, 7, 8 and 9A-9F, when the light cover/door/lid 10 is to be closed, a user presses down so that male prongs from the underside of the cover/door/lid 10 is inserted into female sockets along a rim edge in the opening of the grill 20. Inside of the sockets are springs. Once inserted the male prong becomes locked and hooked in place so that the cover/door/lid 10 is closed over the opening in the grill 20. To open the cover/door/lid 1, a user can press again against the cover/door/lid 10 pushing the male prong deeper into the female sockets which then causes the male prongs to be become ejected by springs inside the bases of the female sockets, and allowing the cover/door/lid 10 to become open. Once open, the bulb 5 is reachable to be changed when needed, such as when the bulb has become burned out.

The exhaust ventilator fan 180 pulls air through the adjustable louvers into the housing 200 and exhausts the air through the side outlet 230 of the housing 200.

The heater uses the same grill inlet to pull air into the housing 200, where the air from the room (space underneath the mounted bath fan) is pulled in and heated. The heated air is pushed back into the space through a different set of adjustable louvers 40. The adjustable louvers 40 on the grill 20 for the heater outlet are pointed away from the grill louvers 25 on the air intake in order to make the system more proficient. Although the vents/louvers 25 on the air intake side are earlier described as fixed, the invention can use also use adjustable louvers on the air intake side as well.

Referring to FIGS. 3-8, the ventilation fan and heater 1 is mounted to a ceiling, C, so that the grill cover 20 is generally flush against the ceiling with the housing 200 behind the ceiling. Incoming air, I can be pulled into fixed vents 24 in the grill cover by the blower 180, where some air is exhausted out, E, through outlet 230, controlled by damper 240. Other incoming air is pulled in the direction of heater components by blower 120, where it is heated by the heating components, and blown back into the space below the ventilation fan and heater 1, by adjustable louvers 40.

Referring to FIGS. 3-5 and 7, a generally V shaped aluminum type light box 60 can be mounted in a middle compartment of the grill cover 20, and can have a socket 65 mounted to one end, and a light source 60 such as a 60 Watt candelabra bulb, mounted therein. The light source can be powered by electrical lines running into the wiring box 220. The invention can use electrical connections used in other bath fan inventions, by the assignee including, but not limited to those shown and described in copending U.S. patent application Ser. No. 13/219,236 filed Aug. 26, 2011, and copending U.S. patent application Ser. No. 13/168,112 filed Jun. 24, 2011, both of which are incorporated by reference.

Into one side edge of the rim of the light box 60 can be a depressibly engageable and depressibly releaseable fastener. A downwardly protruding prong 400 allows the light cover 10 to be easily attachable and fully removable from covering the light source 50 in the light box 60, the operation of which is described in greater detail in reference to FIGS. 9A-9D and 10A-10F.

Figure 9A:
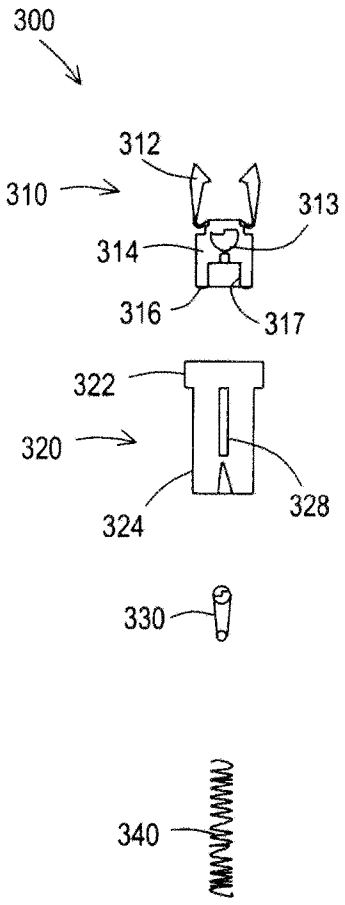
FIG. 9A is an exploded front view of the depressibly engageable and depressibly releasable receptacle fastener used for the light cover of the ventilation and heater fan.
Figure 9B:
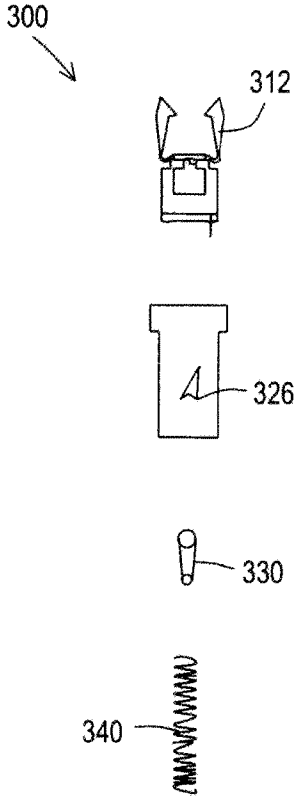
FIG. 9B is an exploded back view of the depressibly engageable and depressibly releasable receptacle fastener of FIG. 9A.
Figure 9C:
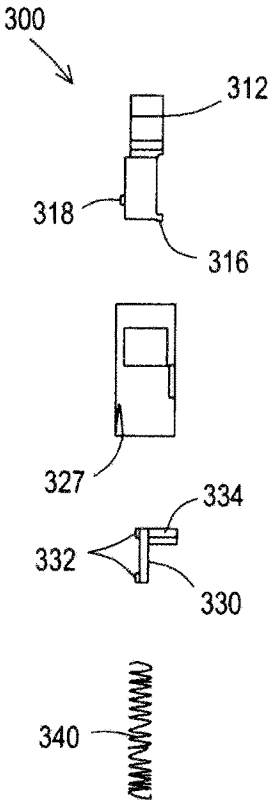
FIG. 9C is an exploded side view of the depressibly engageable and depressibly releasable receptacle fastener of FIG. 9A.
Figure 9D:
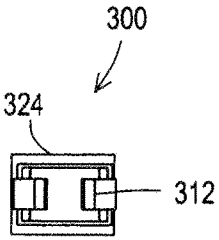
FIG. 9D is a top assembled view of the of the depressibly engageable and depressibly releasable receptacle fastener of FIG. 9A.

FIG. 9A is an exploded front view of the depressibly engageable and depressibly releasable receptacle fastener 300 used for the light cover 10 of the ventilation and heater fan 1 of the preceding figures. FIG. 9B is an exploded back view of the depressibly engageable and depressibly releasable receptacle fastener 300 of FIG. 9A. FIG. 9C is an exploded side view of the depressibly engageable and depressibly releasable receptacle fastener 300 of FIG. 9A. FIG. 9D is a top assembled view of the of the depressibly engageable and depressibly releasable receptacle fastener 300 of FIG. 9A.

Referring to FIGS. 9A-9D, the receptacle fastener 300 can include an inside part inside part 310 with bendable prong arms 312. The inside part 310 can have side walls 314, bottom 316 with an indentation 317. Protruding out of a side wall 314 of the internal part 310 can be a protrusion 318. The side walls 314 of the inside part 310 can fit into an open top end 322 of an outside box 320. Along one side wall(s) 324 of the outside box 320 can be a longitudinal slot 328 which restricts the inner part 310 to an upper position, and to a lower position relative to the box 320. A hook 326 is located on the outside of the box 320, and a spring fixture 327 is on a lower corner of the box 320. A spring 340 can have an upper end into the indentation 317 on the bottom of the inside part 310. An L shaped pot hook 330 can have protrusions 332 on a vertical leg, and a horizontal leg 334 that can fit into a slot opening 313 in the side of the inner part 310, where the inner part 310 can ride up and down in the outside box 320 by the protrusions 332 moving up and down in longitudinal slot 328.

To attach the light cover 10, to the grill cover 20, the unhinged end of the outside of the light cover 10 is first pushed toward the grill cover 20, so that the prong(s) 400 are first pushed (or depressed) into the bendable arms 312. This causes the bendable arms 312 to catch the enlarged prong head 420 while the arms 312 are being pushed into the upper end 322 of the box 320 which partially compresses spring 340. Once the inner part 310 is inside the box 320, the inner part 310 is latched in place. To release the light cover 10, the opposite side of the light cover 10 is pushed toward the housing 100, this causes the inner part 310 to push down again on spring 340, which then releases the latching of the inner part 310. The expanding spring 340 causes the inner part 310 to be pushed to a raised position, with the bendable arms 312 outside the upper end 322 of the box 320, where the arms 312 expand from one another releasing the enlarged prong head(s) 420, and the light cover 10 is then free to pivot open (relative to a hinged end) to allow access to change out the light sources inside of the grill cover 20.

Figure 10C:
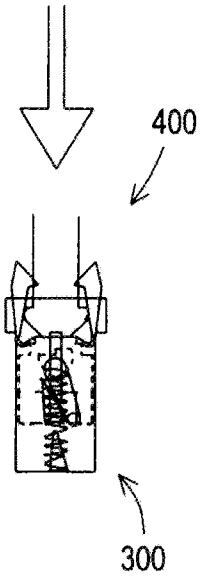
FIG. 10C shows the prong locking into the receptacle fastener of FIG. 10B.
Figure 10B:
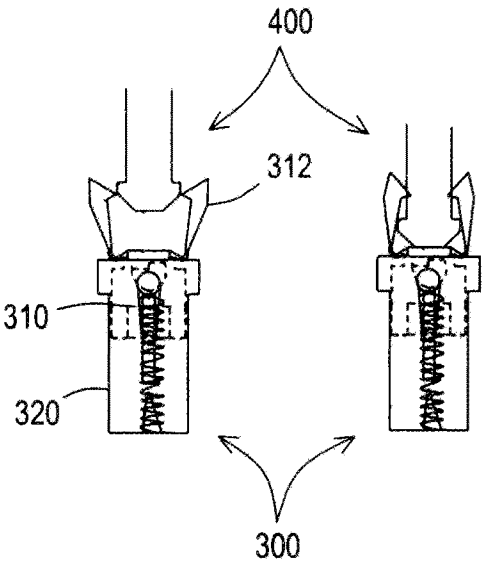
FIG. 10B shows the prong being inserted into the receptacle fastener of FIG. 100A.
Figure 10A:
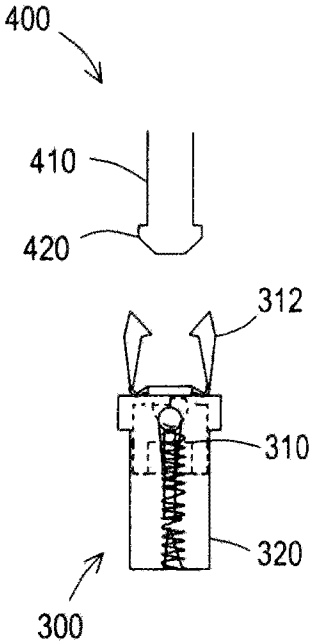
FIG. 10A shows a prong used under the lens cover about to be attached to the assembled receptacle fastener of FIG. 9D.

FIGS. 10A-10D show the steps to lock the prong 400 to the receptacle fastener 300. FIG. 10A shows a prong 400 used under the lens cover 20 about to be attached to the assembled receptacle fastener 300 of FIG. 9D. The prong 400 can have a shaft 410 and an enlarged head 420. The bendable arms 312 can have lower ends attached to top edges of the inner part 310 and have upper inwardly protruding hook ends FIG. 10B shows the prong 400 being inserted into the receptacle fastener 300 of FIG. 10A, where the enlarged head 420 starts to expand the upper hook ends of bendable prongs 312 until the upper hook ends hook about the enlarged head 420 of the prong 400.

FIG. 10C shows the prong 400 locking into the receptacle fastener 300 of FIG. 10B, where the hooked prong head 420 is continued to be pushed into the box 320 so that the spring 340 under the inner part 320 starts to compress inside of the box 320. FIG. 10D shows the prong 400 locked into the receptacle fastener 300 of FIG. 10C. Here, the prong arms 312 are wrapped about the head 420 so that the entire head 420 and substantially most of the arms 312 are inside the upper open end of the box 320. At this point the light cover 10 is fully attached to grill cover 20.

Figure 10F:
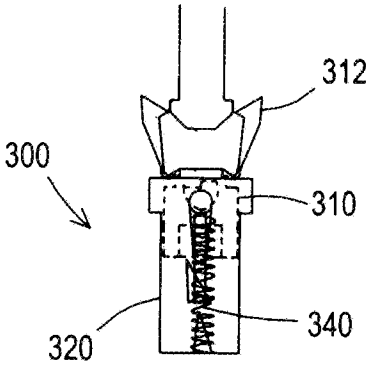
FIG. 10F shows the prong being pushed out of the receptacle of FIG. 10E.
Figure 10E:
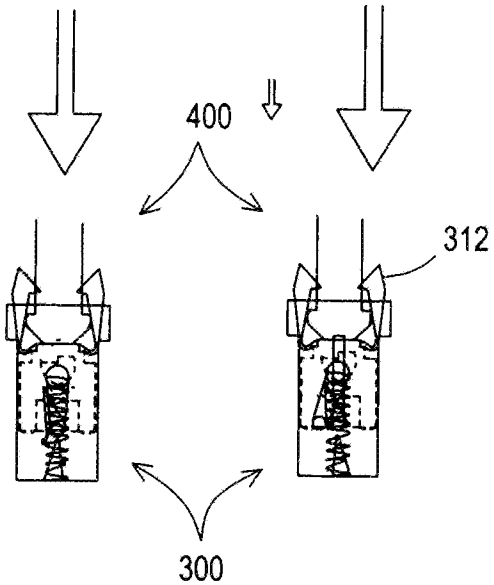
FIG. 10E shows the prong being pushed down again to start the release of the prong.
Figure 10D:
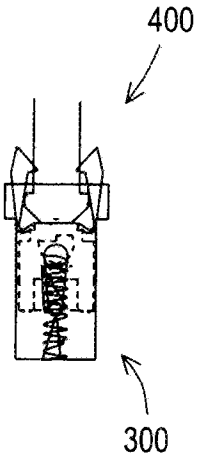
FIG. 10D shows the prong locked into the receptacle fastener of FIG. 10C.

FIGS. 10E-10F show the steps to release a light cover 10 from the grill cover 20 FIG. 10E shows the prong 400 being pushed down again to start the release of the prong 400. By pushing down the prong 400, the inner spring 340 compresses again. FIG. 10F shows the prong 400 being pushed out of the receptacle 300 of FIG. 10E by the spring 340 pushing up against the bottom of inside part 310.

Figure 11:
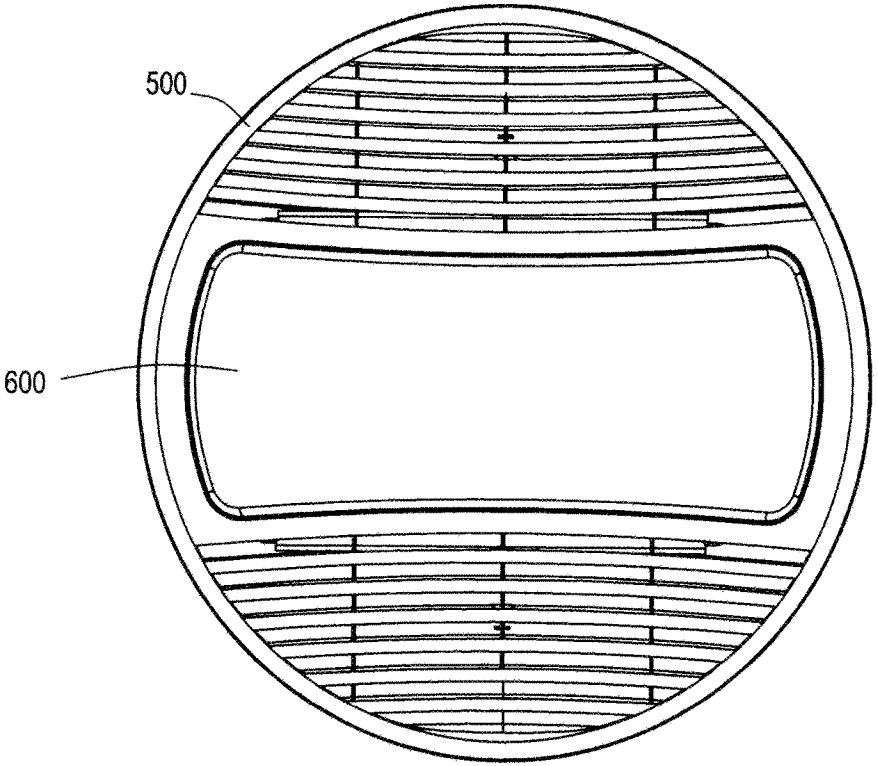
FIG. 11 is a top view of another bath fan grill cover having a lens cover using the depressible engageable fasteners and depressible releases of the preceding figures.
Figure 12:
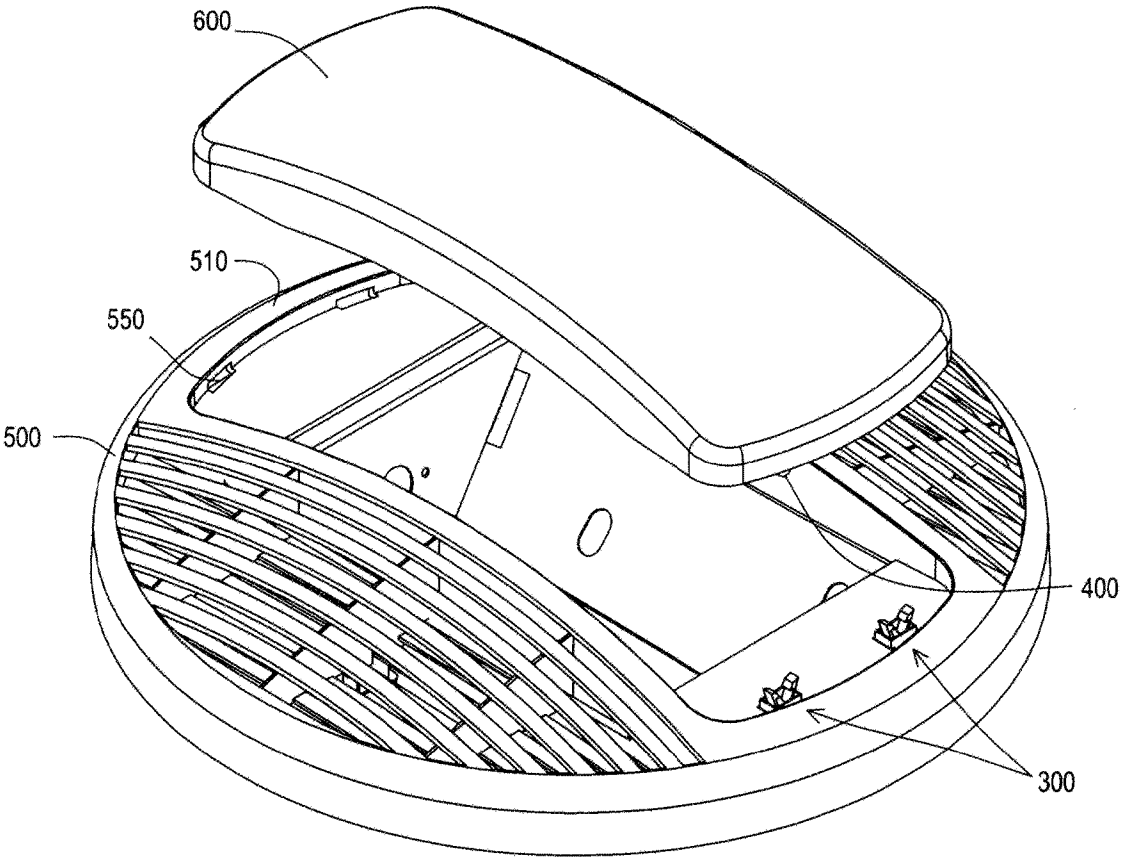
FIG. 12 is a perspective view of the lens cover separated from the grill cover.
Figure 13:
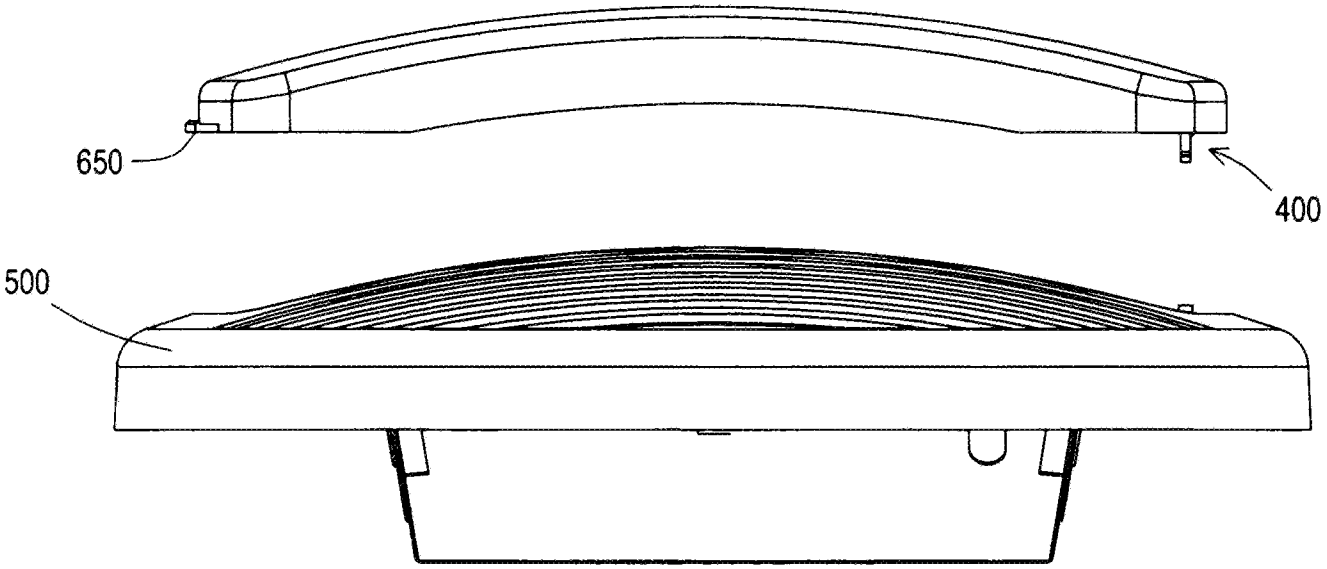
FIG. 13 is a side view of the lens cover separated from the grill cover of FIG. 12.
Figure 14:
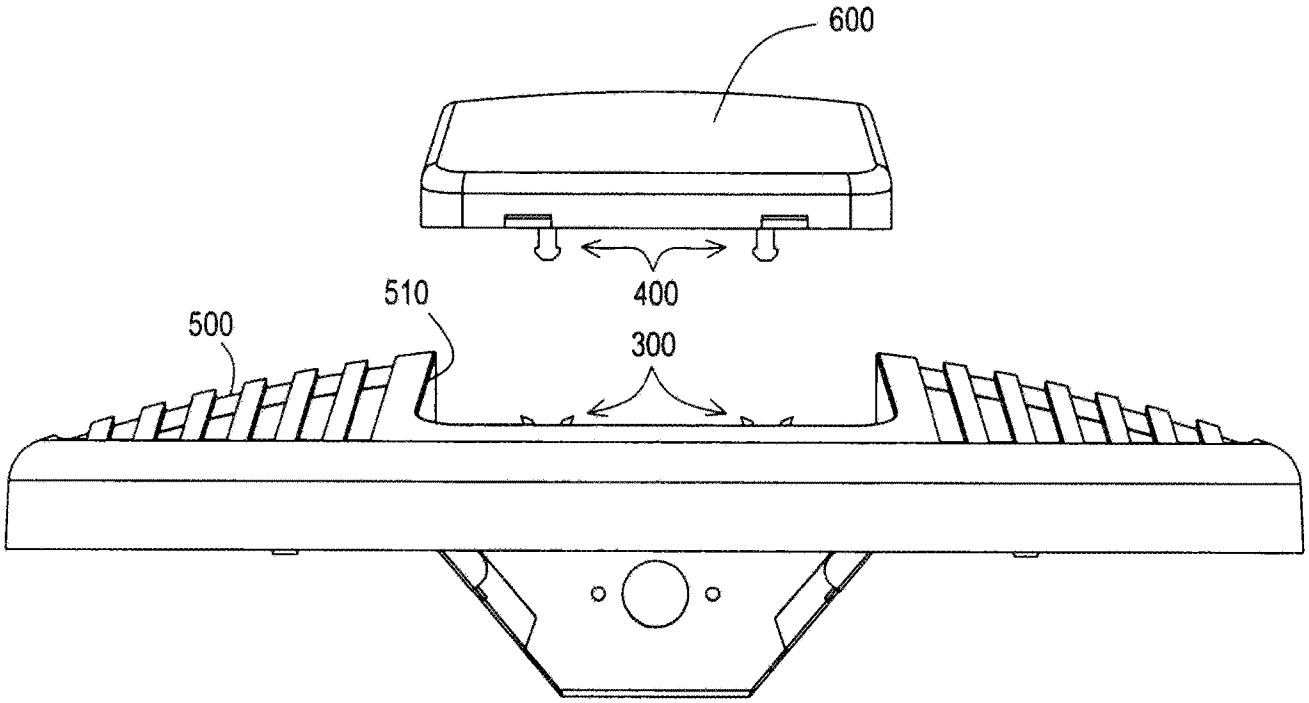
FIG. 14 is another side view of the lens cover separated from the grill cover of FIG. 12.
Figure 15:
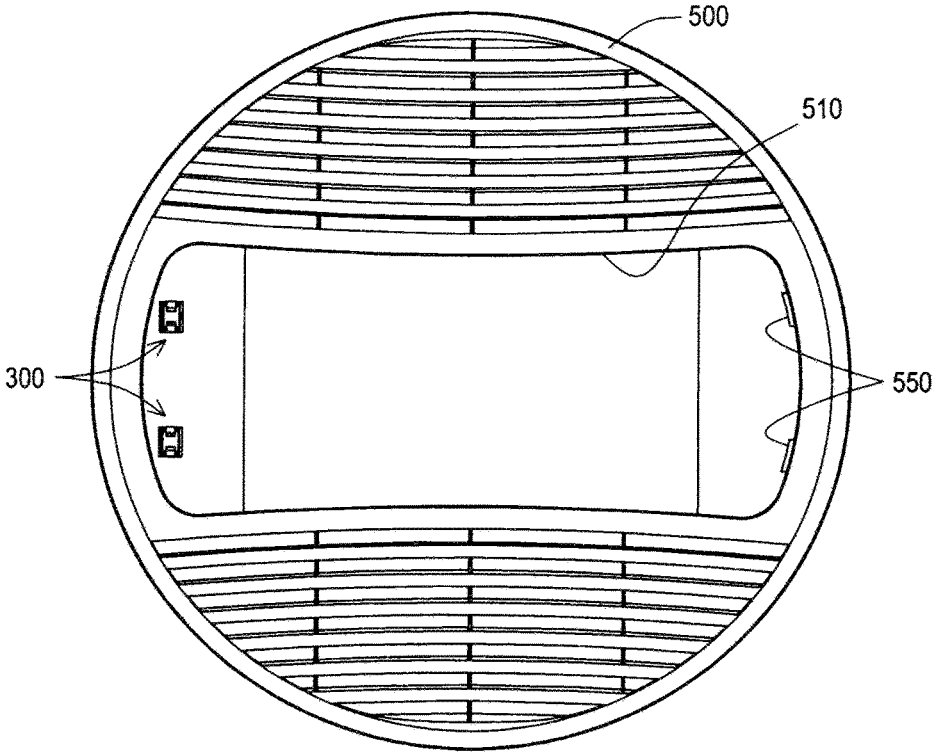
FIG. 15 is a top view of the grill cover of FIG. 11 without the lens cover.
Figure 16:
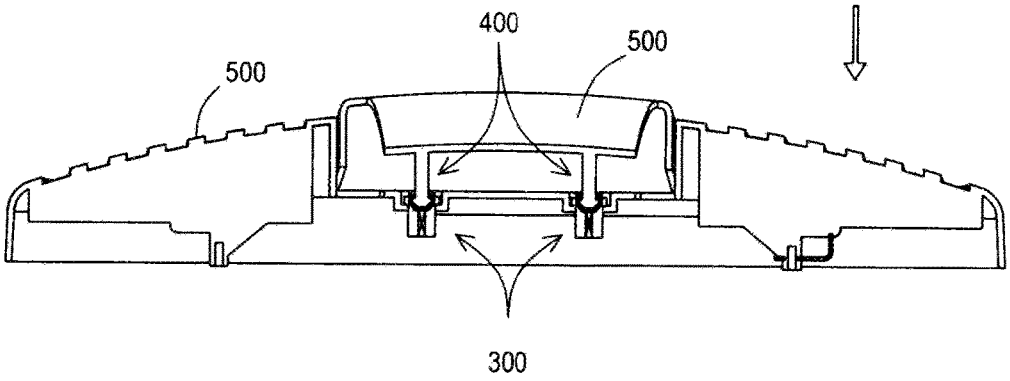
FIG. 16 is a cross-sectional view of the lens cover attached to the grill cover of FIG. 11.
Figure 17:
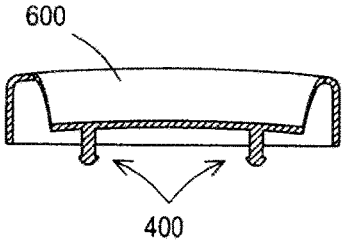
FIG. 17 is a cross-sectional view of the lens cover of FIG. 16.

FIG. 11 is a top view of another grill cover 500 having a lens cover 600 using the depressible engageable fasteners and depressible releases 300, 400 of the preceding figures. FIG. 12 is a perspective view of the lens cover 600 separated from the grill cover 500. FIG. 13 is a side view of the lens cover 600 separated from the grill cover 500 of FIG. 12. FIG. 14 is another side view of the lens cover 600 separated from the grill cover 500 of FIG. 12. FIG. 15 is a top view of the grill cover 500 of FIG. 11 without the lens cover 600. FIG. 16 is a cross-sectional view of the lens cover 600 attached to the grill cover 500 of FIG. 11. FIG. 17 is a cross-sectional view of the lens cover 600 of FIG. 16.

Referring to FIGS. 11-17, the lens cover 600 can be attached to the grill cover 500 using the prongs 400 underneath the lens cover 600 which are depressibly engaged with the receptacle fasteners 300 inside the light cavity 510 of the grill cover 500. One end of the lens cover 600 can have a pair of downwardly protruding prongs 400, which the opposite end can have hinge components 650 which allow the lens cover to be pivotally attached to mateable hinge components 550 inside the light cavity 510 of the grill cover. The prongs 400 with depressibly engageable and depressibly releaseable fasteners 300 function similar to those described in the previous figures. The prongs 400 with depressibly engageable and depressibly releaseable fasteners 300, allow for users to easily change out light bulbs when the bath fan has been mounted in a ceiling, without having to unscrew fasteners, such as screws, bolts, and the like, which are popular with prior art held lens covers.

Figure 18:
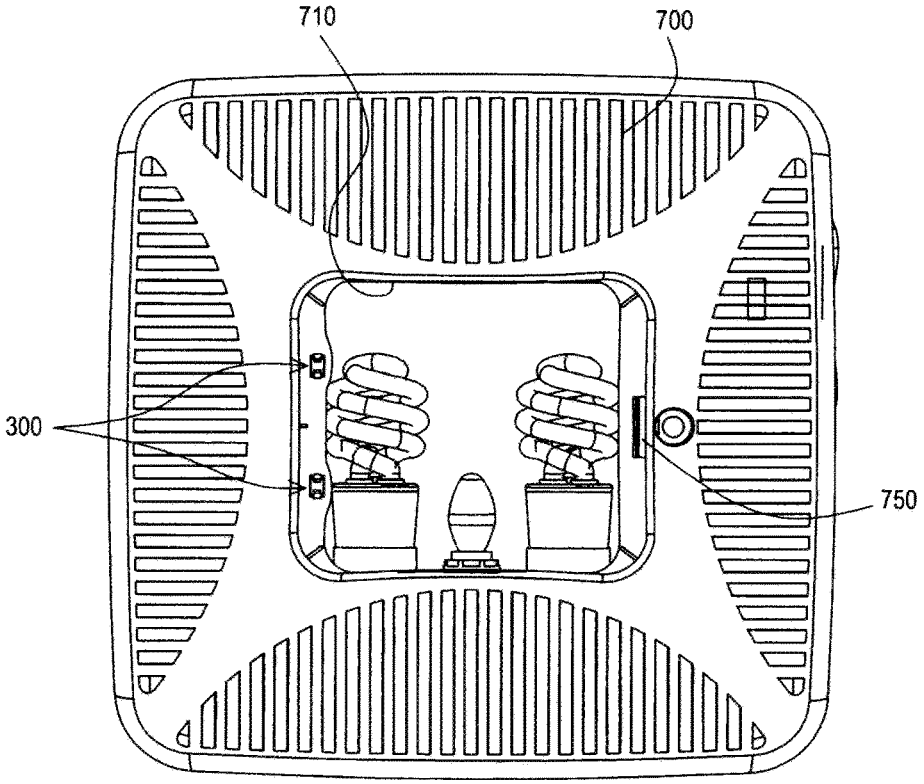
FIG. 18 shows the top view of another bath fan grill cover without the lens cover.
Figure 19:
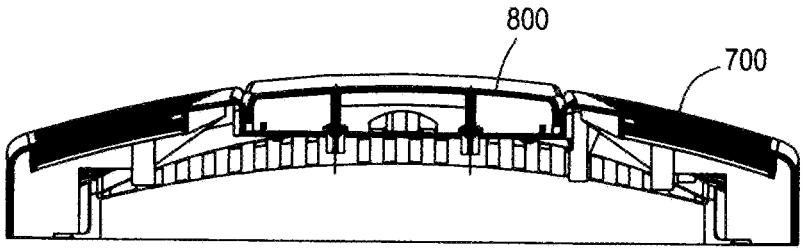
FIG. 19 is a cross-sectional view of the grill cover of FIG. 18 with attached lens cover.
Figure 20:
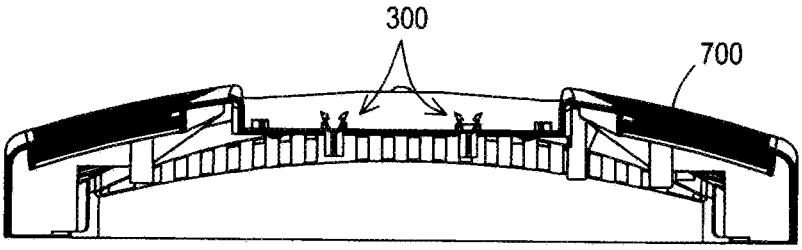
FIG. 20. is a cross-sectional view of the grill cover of FIG. 19.
Figure 21:
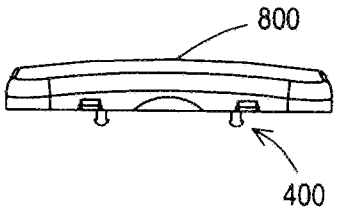
FIG. 21 is an end view of the lens cover of FIG. 19.

FIG. 18 shows the top view of another bath fan grill cover 700 without the lens cover 800. FIG. 19 is a cross-sectional view of the grill cover 700 of FIG. 18 with attached lens cover 800. FIG. 20. is a cross-sectional view of the grill cover 700 of FIG. 19. FIG. 21 is an end view of the lens cover 800 of FIG. 19. Referring to FIGS. 18-21, the grill cover 700 can include a light cavity 71—for supporting bulbs and the like, therein. The cavity 710 can have a pair of depressibly engageable and depressibly releaseable fasteners 300 on one end, and hinge component(s) 750 on an opposite end. The lens cover 800 can attach to and cover the cavity 710 by using a pair of downwardly protruding prongs 400 on one lower end, and hinge components on an opposite lower end which operate and function similarly to the previously described embodiments.

The Exhaust ventilation fan and the heater can be run separately from one another, by having one turned on and the other turned off.

Additionally, the light can be turned on separately from the ventilation fan and the heater.

Additionally, both the exhaust ventilation fan and heater can be run together as desired so that air is continuously circulated out of a space and the rest of the air being heated and recirculated back into the space.

The bath fan can be hardwired to the house and activated by one or two switches on a wall inside of the space underneath the bath fan.

Although the preferred embodiment covers 70 CFM applications, the invention can be used with other levels, such as but not limited to less than or equal to 50 CFM, 60 CFM, 80 CFM, 90 CFM or greater.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A ventilation fan, comprising:

a housing having top, side walls and a bottom, and an exhaust outlet, the bottom adapted to be mounted adjacent to an opening in a ceiling;

a first blower wheel and a first motor for running the first blower wheel, both mounted inside of the housing, the first blower wheel being rotatable in a plane perpendicular to the top of the housing, wherein the first blower wheel has a volute and an outlet;

a plenum located inside of the housing and removably attached to the outlet of the first blower wheel for redirecting air from the first blower wheel in a substantially vertical direction;

a heating element positioned inside the plenum adjacent to the outlet of the first blower wheel;

a second blower wheel and a second motor for running the second blower wheel, both mounted inside of the housing, the second blower wheel being rotatable in a plane perpendicular to the top of the housing, the second blower wheel adjacent to the exhaust outlet in the housing; and a grill cover adjacent to the bottom of the housing having a first longitudinal end and a second longitudinal end, the grill cover having a first grill portion on the first longitudinal end and a second grill portion on the second longitudinal end separate from the first grill portion, the first grill portion having an outlet for allowing outgoing air from the first blower wheel which has been heated by the heating element to be passed out of the housing, the second grill portion having an inlet for allowing air to be pulled into the housing by at least one of the first blower wheel and the second blower wheel.

2. The ventilation fan of claim 1, further comprising:

a light in the grill cover between the first grill portion and the second grill portion with a removable lens cover for covering the light.

3. The ventilation fan of claim 1, wherein one of the first motor and the second motor includes an approximately 70 (seventy) CFM (cubic feet per minute) generating motor.

4. The ventilation fan of claim 2, further comprising:

female sockets in the grill cover behind the lens cover; and male prongs extending below the lens cover for being inserted into the female sockets, wherein the lens cover is attached to and released from the grill cover by the male prongs and female sockets.

5. The ventilation fan of claim 4, further comprising:

moveable inner parts inside of the sockets, wherein the springs are positioned beneath the inner parts; and bendable arms are attached to the inner parts, wherein initially depressing the male prongs into sockets causes the bendable arms to hook about enlarged heads on the male prongs to lock the lens cover in place, and subsequently depressing the male prongs causes the springs to push to out the inner parts to release the lens cover.

6. The ventilation fan of claim 1, further comprising:

a first elongated side telescoping bracket directly mounted along one side wall of the housing; and a second elongated side telescoping bracket directly mounted along an opposite side wall of the housing.

7. The ventilation fan of claim 1, further comprising:

an enclosure surrounding at least one of the first blower wheel and the second blower wheel to prevent excess noise and provide maximum performance in the ventilation fan.

8. The ventilation fan of claim 1, wherein at least one of the first grill portion and the second grill portion includes adjustable louvers so as to direct at least one of the incoming air and the outgoing heated air in separate directions.

9. The ventilation fan of claim 1, wherein the first blower wheel and the second blower wheel are simultaneously switchable to both run at one time.

10. The ventilation fan of claim 1, wherein the first blower wheel and the second blower wheel are separately switchable to run at different times.

11. A ventilation fan, comprising:

a housing having top, side walls and bottom adaptable to be mounted adjacent to an opening in a ceiling;

a first blower wheel and a first motor for running the first blower wheel, both mounted inside of the housing, the first blower wheel having a volute and an outlet;

a plenum located inside of the housing removably attached to the outlet of the first blower wheel for redirecting air in a substantially vertical direction;

a heater for providing heated air inside the plenum adjacent to the outlet of the first blower wheel;

a second blower wheel and a second motor for running the second blower wheel both mounted inside of the housing, and adjacent with the first blower wheel and the first motor, both the first blower wheel and the second blower wheel each rotatable in a vertical plane relative to the bottom of the housing; and a grill adjacent to the bottom of the housing, having a first grill portion for passing outgoing heated air from the first blower wheel to be exhausted from the housing, the grill having a second grill portion for allowing air to be pulled inside the housing by at least one of the first blower wheel and the second blower wheel.

12. The ventilation fan of claim 11, further comprising:

a light adjacent to the grill.

13. The ventilation fan of claim 11, wherein at least one of the first motor and the second motor includes an approximately 70 (seventy) CFM (cubic feet per minute) generating motor.

14. The ventilation fan of claim 11, further comprising:

an enclosure surrounding at least one of the first blower wheel and the second blower wheel which helps prevent excess noise and provide maximum performance to the ventilation fan.

15. The ventilation fan of claim 11, wherein at least one of the first grill portion and the second grill portion includes adjustable louvers so as to direct at least one of the incoming air and the outgoing heated air in separate direction.

16. The ventilation fan of claim 11, wherein the first blower wheel and the second blower wheel are simultaneously switchable to both run at one time.

17. The ventilation fan of claim 11, wherein the first blower wheel and the second blower wheel are separately switchable to run at different times.

18. A ventilation and heating apparatus, comprising:

a housing with top, sides and bottom adaptable to be mounted adjacent to an opening in a ceiling;

a first fan and a first motor for running the first fan, both mounted inside of the housing, the first fan having a volute and an outlet;

a plenum located inside of the housing removably attached to the outlet of the first fan for redirecting air in a substantially vertical direction;

a heater for providing heated air inside the plenum adjacent to the outlet of the first fan;

a second fan and a second motor for running the second fan both mounted inside of the housing, and adjacent with the first fan and the first motor; and a grill adjacent to the bottom of the housing having a first portion for allowing outgoing heated air from the first fan to be exhausted from the housing, the grill having a second portion for allowing incoming air to be pulled inside the housing by at least one of the first fan and the second fan.

19. The ventilation and heating apparatus of claim 18, wherein the first fan and the second fan each include a blower wheel.

* * * * *